US007533724B2

(12) United States Patent
McLaughlin

(10) Patent No.: US 7,533,724 B2
(45) Date of Patent: May 19, 2009

(54) DOWNHOLE INTELLIGENT IMPACT JAR AND METHOD FOR USE

(75) Inventor: Stuart McLaughlin, Conroe, TX (US)

(73) Assignee: Impact Guidance Systems, Inc., Spring, TX (US)

( * ) Notice: Subject to any disclaimer, the term of this patent is extended or adjusted under 35 U.S.C. 154(b) by 0 days.

(21) Appl. No.: 11/899,933

(22) Filed: Sep. 8, 2007

(65) Prior Publication Data

US 2008/0087424 A1 Apr. 17, 2008

Related U.S. Application Data

(60) Provisional application No. 60/843,256, filed on Sep. 8, 2006.

(51) Int. Cl.
*E21B 31/107* (2006.01)

(52) U.S. Cl. ..... 166/301; 166/178; 175/302

(58) Field of Classification Search ..... 166/178, 166/301; 175/299, 303, 293, 302; 173/120, 173/90, 91, 118
See application file for complete search history.

(56) References Cited

U.S. PATENT DOCUMENTS 3,024,854 A * 3/1962 Coffee ..... 175/299
5,330,018 A * 7/1994 Griffith ..... 175/299
6,176,325 B1 * 1/2001 Rodger ..... 175/50
7,367,397 B2 * 5/2008 Clemens et al. ..... 166/301
2001/0018974 A1 * 9/2001 Mouton et al. ..... 166/301
2003/0147360 A1 * 8/2003 Nero et al. ..... 370/314
2004/0188085 A1 * 9/2004 Tillett, Jr. ..... 166/178
2005/0183889 A1 * 8/2005 Marsh ..... 175/302
2005/0194185 A1 * 9/2005 Gleitman ..... 175/45
2006/0169456 A1 * 8/2006 Evans ..... 166/301
2006/0243447 A1 * 11/2006 McElroy et al. ..... 166/301
2007/0151732 A1 * 7/2007 Clemens et al. ..... 166/301

* cited by examiner

*Primary Examiner*—David J Bagnell
*Assistant Examiner*—Cathleen R Hutchins
(74) *Attorney, Agent, or Firm*—Shawn Hunter

(57) ABSTRACT

An intelligent downhole impact jar device is described that is able to sense well bore angle or deviation and alter the effective jar impact load based upon the sensed information. The impact jar device includes a jarring portion for creating jarring impacts within a wellbore toolstring. The jarring portion is adjustable so that jarring forces of various levels can be produced. The jarring portion is adjusted in response to sensed wellbore conditions, such as the angle of deviation of the surrounding wellbore.

12 Claims, 7 Drawing Sheets

DOWNHOLE INTELLIGENT IMPACT JAR AND METHOD FOR USE

This application claims the benefit of U.S. Provisional Patent Application Ser. No. 60/843,256 filed Sep. 8, 2006.

BACKGROUND OF THE INVENTION

1. Field of the Invention

The present invention relates generally to mechanical jars that perform impact-related forces on a tool string downhole in hydrocarbon wells, water wells, or other well applications.

2. Description of the Related Art

Well operations often require the use of devices that provide an "impact" on a tool string or a downhole production device. Certain types of downhole tools require the shearing of screws or pins to either set or release a device. A downhole packer or bridge plug, for example, may be run into a wellbore on wireline and then set in place within the is wellbore by shearing screws on the run-in tool. To do this, an impact load will need to be delivered to the run-in tool that is sufficient to cause shearing to occur. In other applications, a device that is being installed in or removed from a production string by wireline or coiled tubing may require impacts to properly install or remove it. For example, gas-lift valves are typically installed in and removed from the pocket of a gas-lift mandrel by a wireline tool. Removing the gas lift valve from the pocket requires the application of an impact force to unseat the valve from the pocket.

Typically, a mechanical, hydraulic or spring-type jarring tool is used to deliver the impact forces for these situations. With these tools, the impact force is predetermined and calibrated at the surface prior to running the jarring tool in to the wellbore. However, the actual impact force that will be delivered while in the hole will vary depending upon the various well environments and geometries that exist. One important aspect of wellbore geometry is wellbore angle or deviation. Wellbore deviation applies increased friction forces on the tool string and thereby results in reduced impact forces being applied by the jarring tool. In particular, spring jars require pre-set calibration at the surface by manually applying torque to the spring mechanism prior to running the tool in. However, this is not optimal where the wellbore angle is unknown or if wellbore angle changes along the length of the wellbore.

SUMMARY OF THE INVENTION

An intelligent downhole impact jar device is described that is able to sense well bore angle or deviation and alter the effective jar impact load based upon the sensed information. In an exemplary embodiment, the impact jar device includes a jarring portion for creating jarring impacts within a wellbore toolstring. The jarring portion is adjustable so that jarring forces of various levels can be produced. The device also includes a sensor for determining a wellbore condition, principally the angle of deviation of the surrounding wellbore, and generating a signal indicative of the wellbore condition. In addition, the impact jar device includes a controller to receive the signal from the sensor and adjust the jarring portion to produce a jarring impact of suitable force to match the wellbore condition. For example, if the wellbore is deviated and the jarring force provided by the impact jar will be reduced by the deviation, the controller will adjust the jarring assembly so as to correspondingly increase the force of the jarring impact the jarring assembly will create, thereby increasing the effective jarring force to compensate for the wellbore deviation.

BRIEF DESCRIPTION OF THE DRAWINGS

For detailed understanding of the invention, reference is made to the following detailed description of the preferred embodiments, taken in conjunction with the accompanying drawings in which reference characters designate like or similar elements throughout the several figures of the drawings.

DETAILED DESCRIPTION OF THE PREFERRED EMBODIMENTS

Figure 1A:
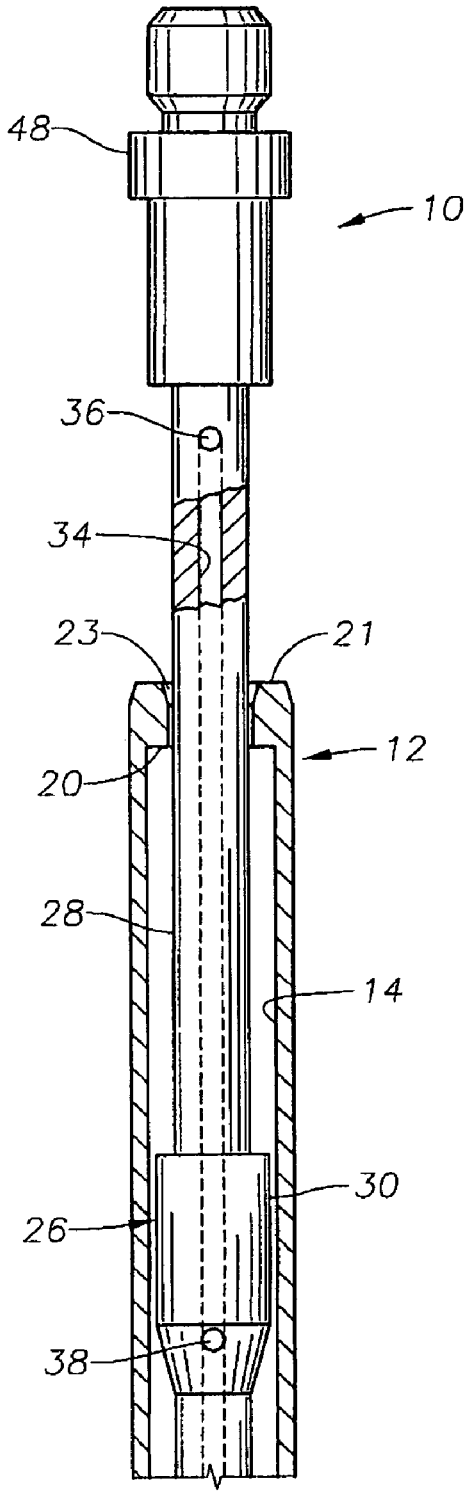
FIGS. 1A-1C present a side, cross-sectional view of an exemplary intelligent impact jar tool constructed in accordance with the present invention, and in a run-in position.

FIGS. 1A-1D illustrate an exemplary intelligent impact jar device 10, which is adapted to be secured within a production string (not shown) in a wellbore. The jar device 10 includes an outer tubular housing, generally indicated at 12, that defines a bore 14 along its length. The bore 14 includes upper and lower enlarged diameter upsets 16, 18 proximate its upper end 20. The upper end 21 of the housing 12 has a reduced diameter neck 23. The housing 12 is attached at its lower end 22 to a lower end sub 24.

Disposed radially within the bore 14 of the housing 12 is an impact anvil 26 having a reduced diameter shaft portion 28, an enlarged diameter anvil portion 30 and a retaining portion 32. An equalizing passage 34 is defined within the impact anvil 26 and extends between port openings 36, 38, and 40. The retaining portion 32 of the anvil 26 carries a release bearing 42 having a collar 44 and ball bearings 46. The release bearing 42 is removably secured to the retaining portion when the ball bearings 46 reside within a complimentary annular relief 50, which is visible in FIG. 3B. The upper end of the anvil 26 is affixed to a top sub 48, which has a connection suitable for attaching the jar device 10 to a desired wireline or coiled tubing running arrangement (not shown).

The release bearing 42 is secured by threading or similar fashion to spring housing 52, which resides within bore 14. Within the spring housing 52 is a compressible spring 54. In a currently preferred embodiment, the spring 54 is made up of stacked Belleville washers. However, a coiled spring or fluid spring may be used as well. A spring compression member, or rod, 56 is disposed within the spring housing 52 as well and extends through the lower axial end of the spring housing 52. The lower end of the compression rod 56 is secured to the spindle of rotary motor 58. The motor 58 is secured within the bore 14 below the spring housing 52. Spring 60 is disposed between the spring housing 52 and the motor 58. A battery pack or other power supply 62 provides power for the motor 58 to operate. The upper end of the compression rod 56 has an enlarged compression head 64 that is located above the spring 54. Compression of the spring 54 by the spring compression rod 56 and affixed head 64 pre-tensions the release bearing 42 upon the retaining portion 32 of the impact anvil 26. The compression rod 56 also includes a screw shaft 65, which is the portion that is affixed to the rotary spindle of the motor 58. Rotation of the screw shaft 65 in one direction by the motor 58 will shorten the screw shaft 65 and cause the compression head 64 to compress the spring 54. Rotation of the screw shaft 65 in the opposite direction will uncompress the spring 54. When the spring 54 is compressed by the motor 58, the jar force provided by the tool 10 is increased due to increased spring loading and pre-tensioning. Conversely, when the spring 54 is uncompressed, by operation of the motor 58 in reverse, the jar force provided by the tool 10 is decreased.

Figure 1B:
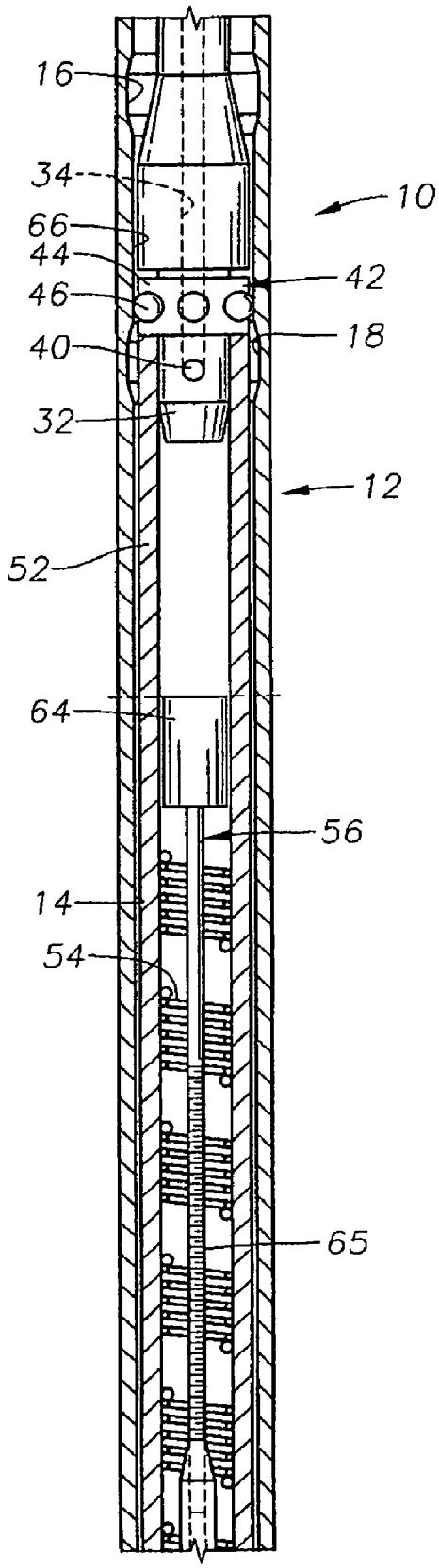
Figure 1C:
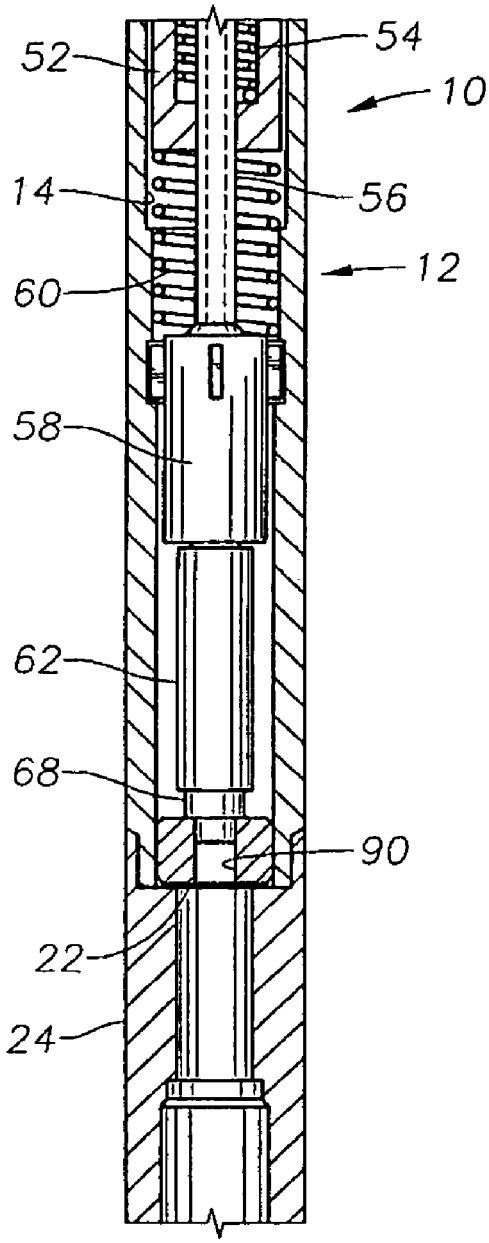
Figure 2A:
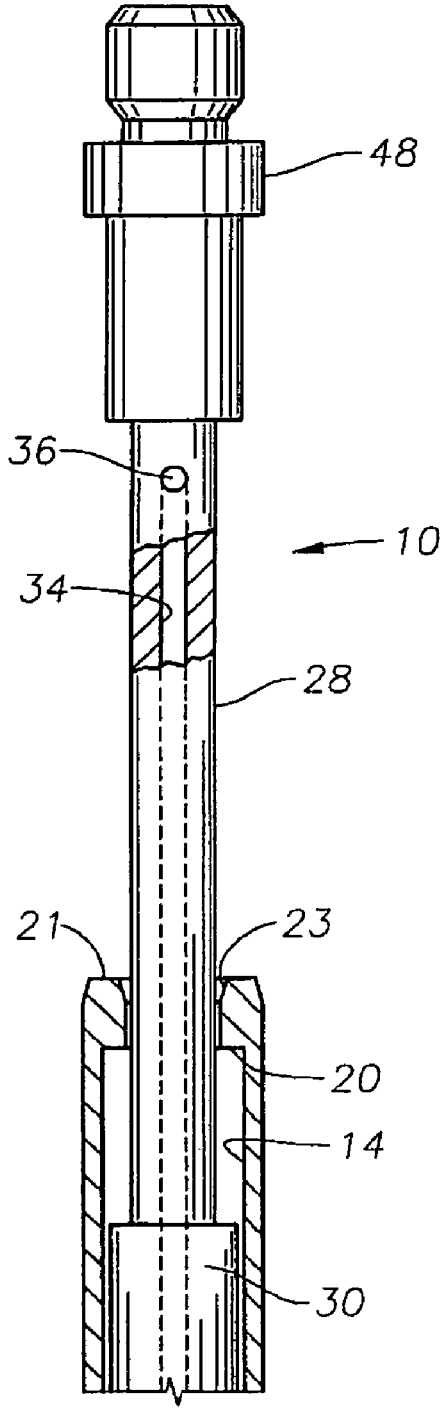
FIGS. 2A-2C present a side, cross-sectional view of the impact jar tool of FIGS. 1A-1B, now with the jar having been actuated in preparation for a jar impact.
Figure 2B:
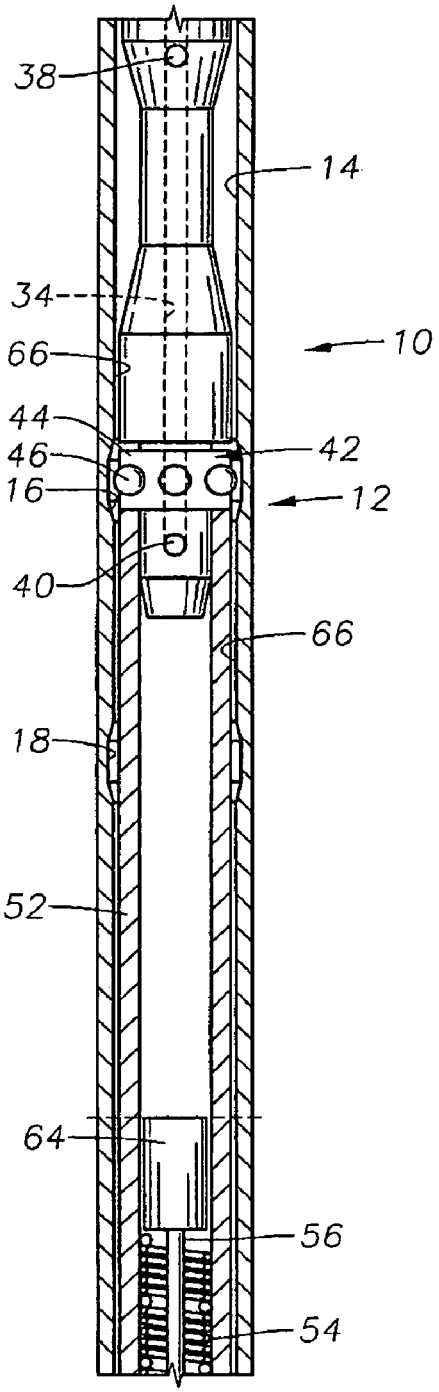
Figure 2C:
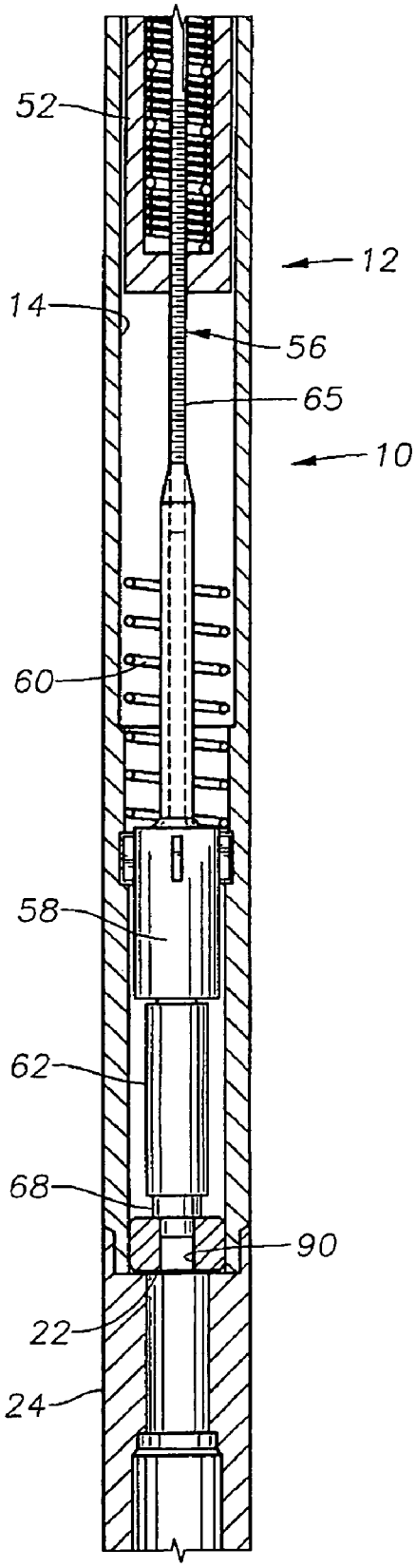
Figure 3A:
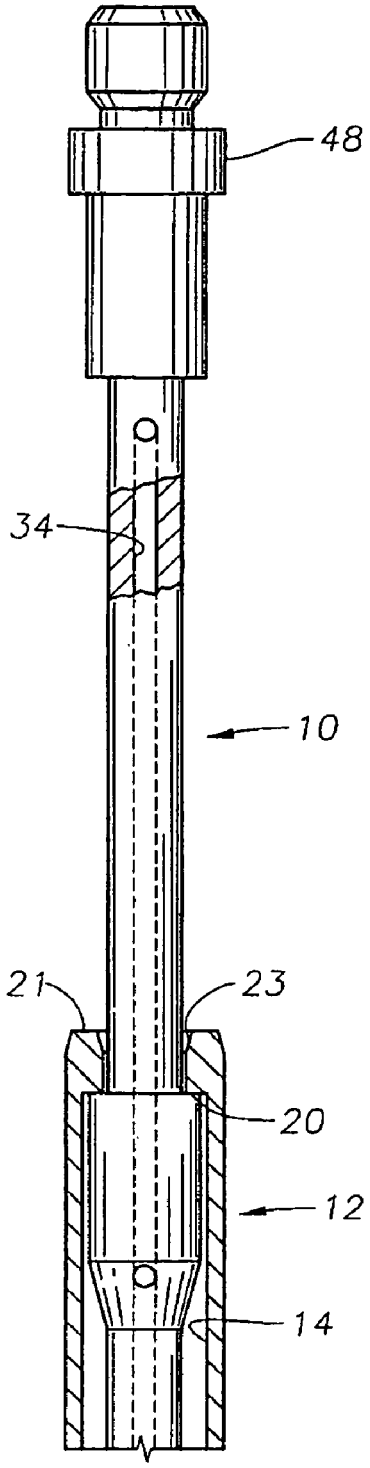
FIGS. 3A-3C depict the impact jar tool of FIGS. 1A-1B and 2A-2B during jarring.
Figure 3B:
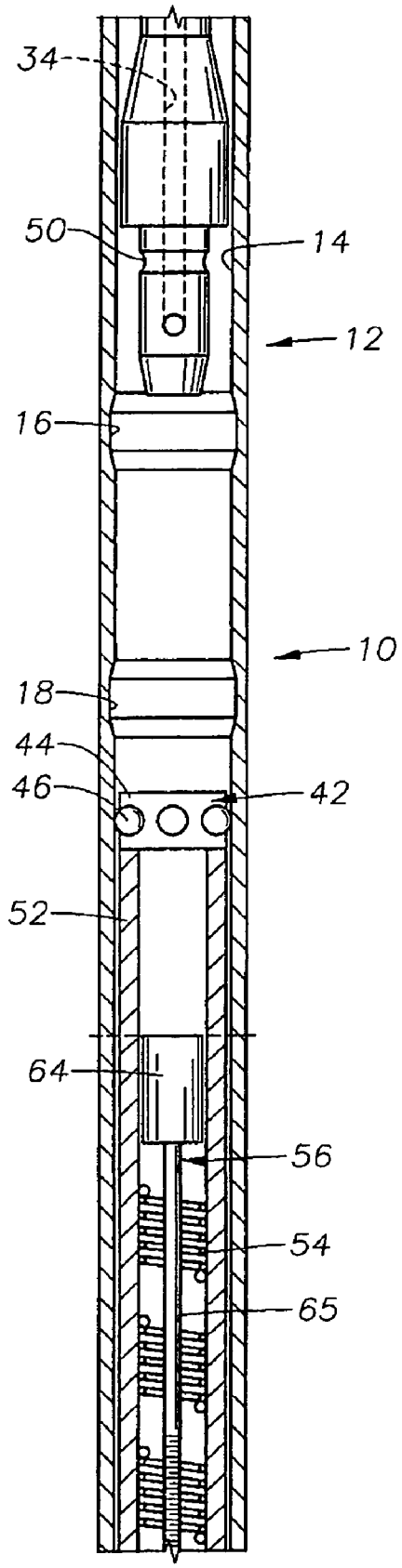
Figure 3C:
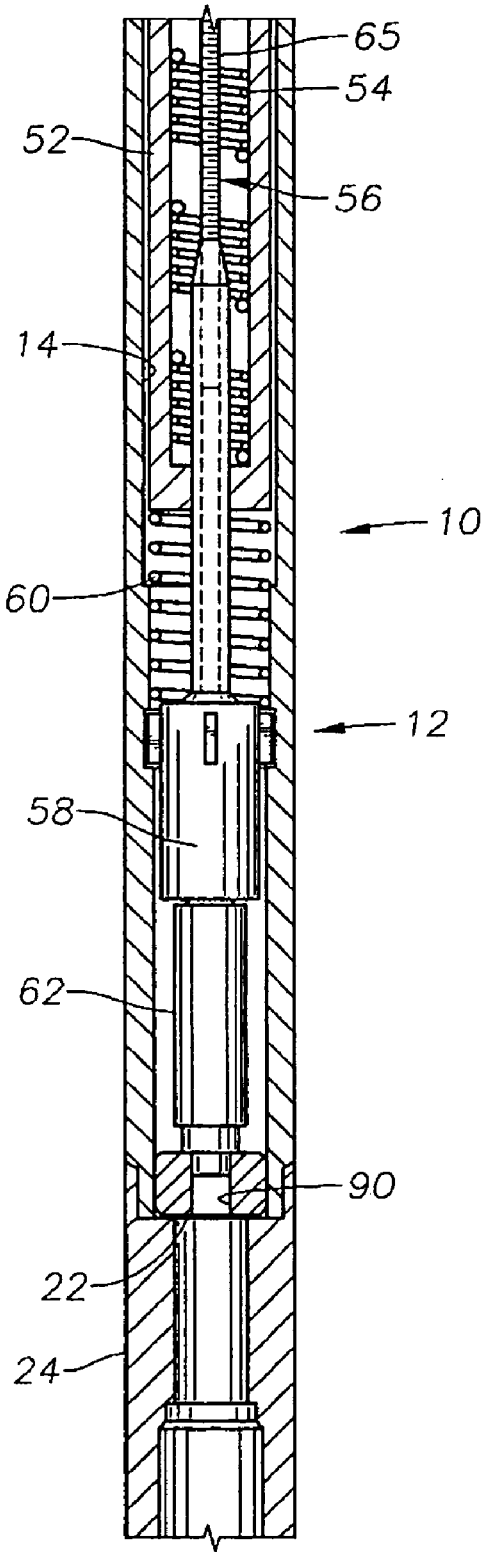
Figure 4A:
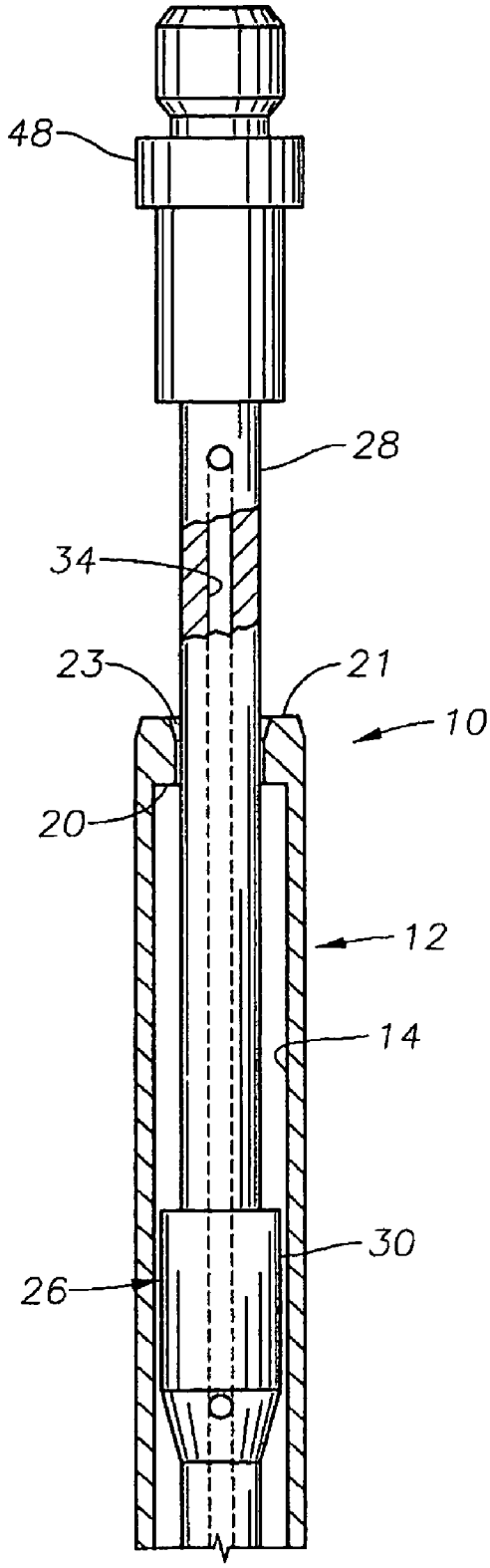
FIGS. 4A-4C illustrate the impact jar tool now being adjusted for downhole angle.
Figure 4B:
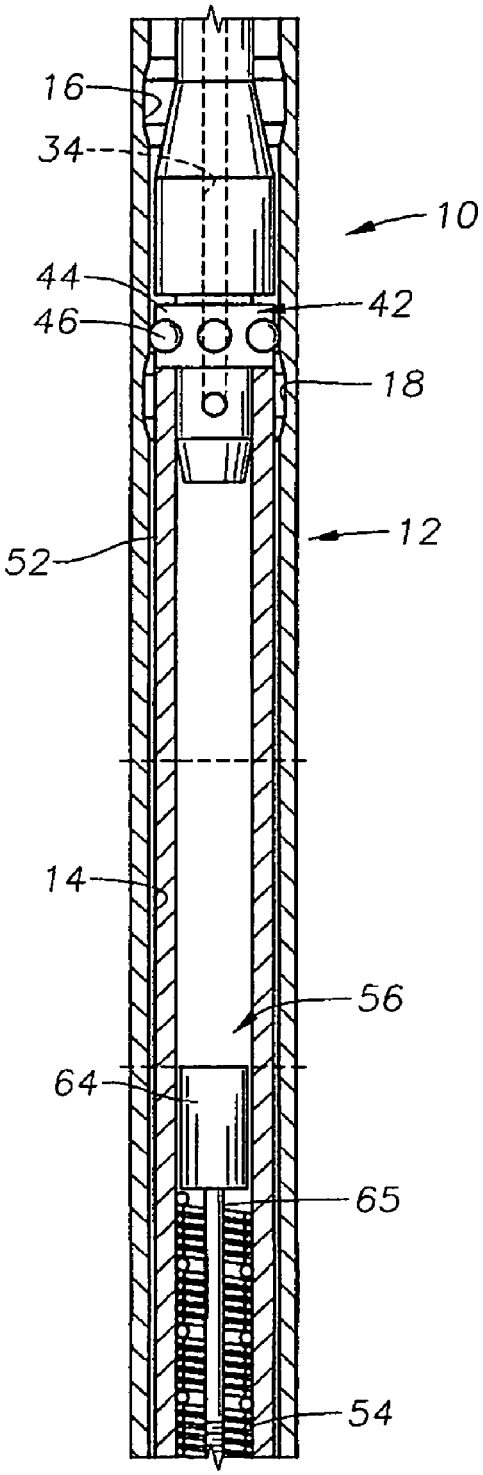
Figure 4C:
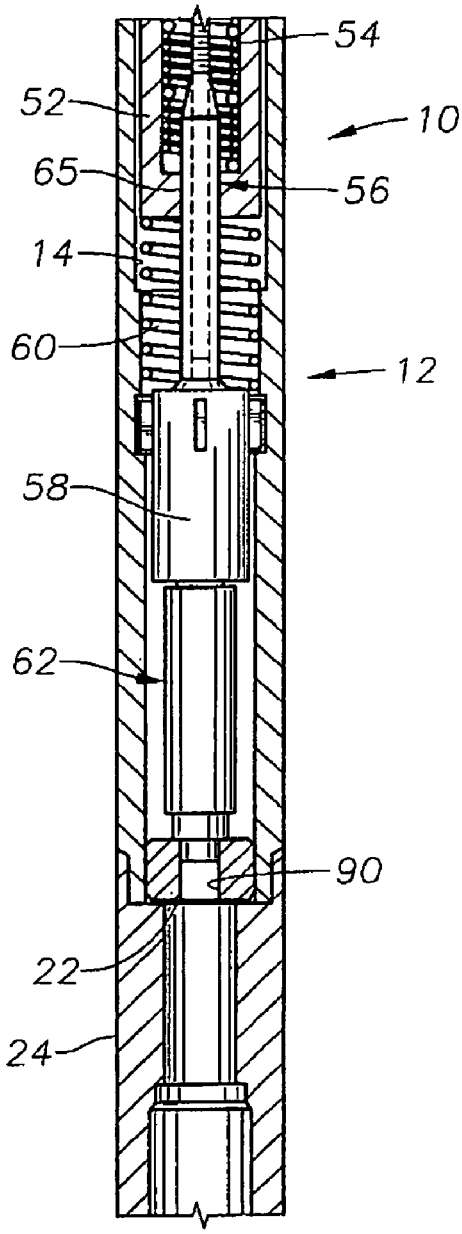

During run-in, the jar device 10 is in the configuration shown in FIG. 1A-1C. In order to cause the jar device 10 to create an impact, the top sub 48 is pulled upwardly, drawing the anvil 26 upwardly with respect to the housing 12 to place the anvil 26 in tension. When the anvil 26 reaches the position shown in FIGS. 2A-2C, the ball bearings 46 of the release bearing 42 will encounter the enlarged diameter upset 16. The ball bearings 42 will move radially outwardly into the upset 16 and allow the retaining portion 32 of the anvil 26 to be move out of the relief 50 on the retaining portion 32. As a result, the retaining portion 32 is released from attachment to the release bearing 42 and spring housing 52 (see FIG. 3B). This release will happen very quickly, as the anvil 26 is pulled upwardly in tension. When the anvil 26 is released from the release bearing, the enlarged portion 30 of the anvil 26 will strike against the upper end 20 of the bore 14, as shown in FIG. 3A. This striking action creates the jarring impact that the tool 10 is intended to deliver. The presence of the equalizing passage 34 and ports 36, 38, 40 will permit the anvil 26 to move within the bore 14 of the housing 12 without hindrance by fluid pressure differentials that might otherwise prevent the desired impact jar from occurring.

Following the jar impact described above, the tool 10 must be reset before a second impact can be performed. To reset the tool, the anvil 26 is moved axially downwardly with respect to the housing 12. The retaining portion 32 is reinserted into the release bearing 42 and urge the release bearing 42 and affixed spring housing 52 axially downwardly within the housing 12. This downward movement of the anvil 26 will be resisted by the compression spring 60, which will compress during the downward movement. As the release bearing 42 enters the lower upset 18, the ball bearings 46 of the release bearing 42 can move radially outwardly into the upset 18, thereby allowing the retaining portion 32 to be moved within the release bearing 42 to a point wherein the ball bearings 46 will become aligned with its relief 50. At this, point the spring 60 may decompress to urge the spring mandrel 52 and anvil 26 axially upwardly with respect to the housing 12. The release bearing 42 will move out of the enlarged diameter upset 18 and is into a restricted diameter portion 66 of the bore 14 located between the upper and lower upsets 16, 18, thereby securing the anvil 26 to the release bearing 42 and the spring housing 52. Following this resetting, the jarring tool 10 may be again actuated to cause an impact jar, as described previously.

Figure 5:
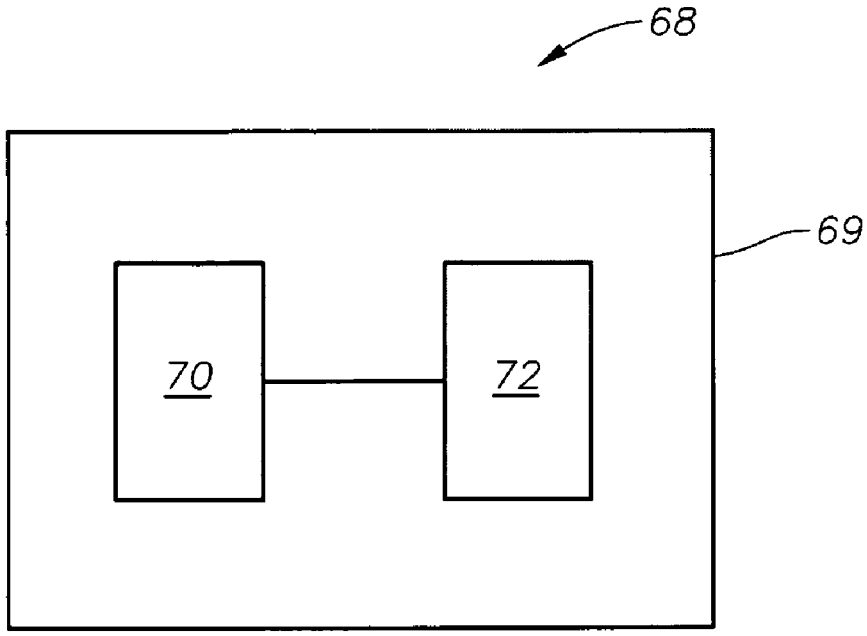
FIG. 5 is an illustration of an exemplary controller constructed in accordance with the present invention.

The jar device 10 is also capable of self-adjustment to alter the amount of impact force that is delivered by the jar device 10. A controller 68 is operably associated with the motor 62 and governs the adjustment of the impact jar force via adjustment of the compression spring 54 by compression rod 56 and motor 62. Upon receipt of a suitable command from the controller 68, the motor 62 will rotate the screw shaft 65 in order to adjust the jarring force (either increase or decrease) that will be provided by the tool 10. In a currently preferred embodiment, depicted schematically in FIG. 5, the controller 68 comprises a circuit board 69 having an on-board inclinometer 70 that is capable of detecting the angle from the vertical at which the tool 10 is oriented. Inclinometers of this type are available commercially from a number of commercial sources, including various suppliers of MEMS (microelectromechanical systems) devices, such as Analog Devices of Norwood, Mass. In a currently preferred embodiment, the inclinometer 70 is a spring system made of silica. The controller 68 is also provided with a processor 72 that receives the data obtained by the inclinometer 70 and determines the amount of adjustment that is needed to be made to the compressible spring 54 to compensate in the loss effective jarring force resulting from the deviation angle of the surrounding wellbore. The controller 68 is also capable of providing a command signal to the motor 58 to cause the motor 58 to operate in a particular manner.

The controller 68 is preprogrammed at the surface with the parameters necessary to allow the controller 68 to determine the amount of frictional losses upon the impact jar device 10 as a result of deviations in the angle of the surrounding wellbore as measured by the inclinometer 70. These parameters will likely include the weight of the jar tool 10 and associated components as well as the coefficient of friction for the material making up the surrounding wellbore or wellbore casing (either measured or obtained from widely-available reference sources).

Figure 6:
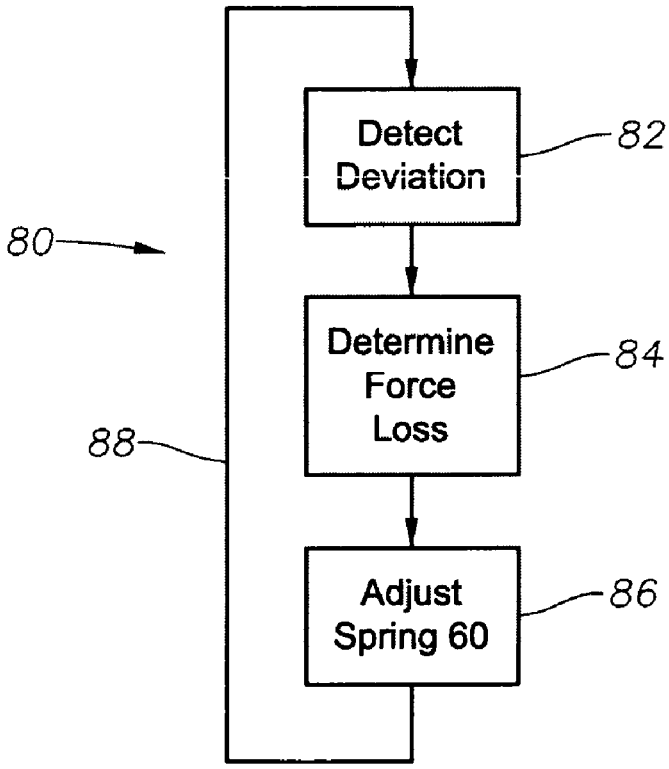
FIG. 6 is a diagram depicting operational steps taken by the controller to adjust the impact jar jarring force to compensate for deviations in wellbore deviation angle.

Exemplary operation of the controller 68 to adjust the impact force of the jar tool 10 is depicted schematically in FIG. 6. According to step 82 of the process 80, the inclinometer 70 detects the angle of deviation of the surrounding wellbore from the vertical and transmits this information to the controller 68. In step 84, the controller 68 determines an approximated amount of impact force loss due to the angular deviation. The determination of force loss may be done by applying known frictional coefficients and friction determination equations to calculate, from the detected angle of deviation and the known material of the surrounding wellbore, a friction force loss amount. For example, if the surrounding wellbore is lined with iron casing sections, an approximate kinetic frictional coefficient ($\mu$) of 0.20 (obtained from published source materials) can be used by the controller 68 to determine the amount of force that is necessary to overcome the frictional losses from the angled deviation of the wellbore. In this example, if the inclinometer 70 were to determine that the impact jar tool 10 were deviated, say 10 degrees from the vertical, the friction force loss due to the deviation could be determined by the equation:

$F_1 = N\mu$ where:

$F_1$ is the friction force loss (i.e., the frictional force resisting motion of the impact jar tool 10);

N is the component of force exerted upon the wellbore surface by the weight of the tool 10; and $\mu$ is the coefficient of friction.

In step 86, the controller 68 provides a command to the motor 58 to increase the compression of the spring 54 by rotation of the screw shaft 65 to cause the compression head 64 to compress the spring 54, thereby creating a pre-tension condition upon the impact anvil 26. As the spring 54 is axially compressed (see FIG. 2B), the force with which the impact anvil 26 will impact the upper end 20 of the bore 14 of housing 12 will be correspondingly increased. This process may be repeated by the controller 68, as illustrated by arrow 88 in FIG. 6, to provide for a constantly updating, iterative process that is repeated in accordance with a programmed timed cycle.

The necessary wiring and programming needed to accomplish the above-described steps 82, 84, and 86 will be apparent to those of skill in the art of programming microprocessors. The controller 68 is preferably programmed with the desired parameters prior to running the tool 10 into a wellbore. To do this, a serial interface port 90 is provided which allows the controller 68 to be connected up to a programming computer at the surface of the well prior to running the tool 10 into the well.

Those of skill in the art will recognize that, although the present invention is shown and described in a limited number of forms herein, it is amenable to various changes and modifications without departing from the scope and spirit of the invention.

What is claimed is:

1. An impact jar device incorporated within a toolstring in a wellbore, the jar device comprising:

a jarring portion for imparting jarring impacts to the toolstring, the jarring portion being adjustable to create jars of various force levels;

a sensor for determining an angle of deviation of the surrounding wellbore from vertical and providing a signal representative of such condition; and a controller to receive the signal from the sensor and, in response, adjust the force level of the jarring impact provided by the jarring portion to match the wellbore condition.

2. The impact jar device of claim 1 wherein the jarring portion comprises:

a striking surface;

an impact anvil for impacting the striking surface to create a jarring impact; and a release assembly for retaining and releasing the impact anvil to strike the striking surface to create a jarring impact.

3. The impact jar device of claim 2 wherein the release assembly comprises:

a spring housing;

a release member associated with the spring housing for releasably retaining the impact anvil;

a compressible spring disposed within the spring housing; and a spring compressing member to compress the spring and pretension the release member, the spring compressing member comprising a telescoping shaft having first and second shaft members that are telescopically moveable with respect to one another to adjust the force level of jarring impact provided by the jarring portion.

4. The impact jar device of claim 3 wherein:

the first and second shaft members are telescopically moveable by rotation of the first and second shaft members with respect to one another; and the controller adjusts the force level of the jarring impact by rotating the first shaft member with respect to the second shaft member.

5. The impact jar device of claim 1 wherein the sensor comprises an inclinometer.

6. The impact jar device of claim 1 wherein the controller determines a loss of impact force from the angle of deviation and adjusts the force level of jarring impact based upon that loss.

7. An impact jar device incorporated within a toolstring in a wellbore, the jar device comprising:

a jarring portion for imparting jarring impacts to the toolstring, the jarring portion being adjustable to crate jars of various force levels;

an inclinometer for determining an angle of deviation from vertical of the surrounding wellbore and providing a signal representative of such condition; and a controller to receive the signal from the sensor and, in response, adjust the force level of the jarring impact provided by the jarring portion to match the angle of deviation.

8. The impact jar device of claim 7 wherein the jarring portion comprises:

a striking surface;

an impact anvil for impacting the striking surface to create a jarring impact; and a release assembly for retaining and releasing the impact anvil to strike the striking surface to create a jarring impact.

9. The impact jar device of claim 8 wherein the release assembly comprises:

a spring housing;

a release member associated with the spring housing for releasably retaining the impact anvil;

a compressible spring disposed within the spring housing; and a spring compressing member to compress the spring and pretension the release member, the spring compressing member comprising a telescoping shaft having first and second shaft members that are telescopically moveable with respect to one another to adjust the force level of jarring impact provided by the jarring portion.

10. The impact jar device of claim 9 wherein:

the first and second shaft members are telescopically moveable by rotation of the first and second shaft members with respect to one another; and the controller adjusts the force level of the jarring impact by rotating the first shaft member with respect to the second shaft member.

11. The impact jar device of claim 7 wherein the controller determines a loss of impact force from the angle of deviation and adjusts the force level of jarring impact based upon that loss.

12. A method of imparting an adjustable jarring impact to a toolstring within a wellbore comprising the steps of:

a) incorporating a jarring device into a wellbore toolstring, the jarring device having a jarring portion for creating jarring impacts within the toolstring, the jarring portion being adjustable to create jars of various force levels;

b) disposing the jarring device and toolstring into a wellbore;

c) determining an angle of deviation from vertical of the tool within the wellbore;

d) calculating an adjustment to the jarring portion based upon the determined angle of deviation;

e) thereafter adjusting the jarring portion so that the jarring portion will provide a jar of a predetermined level of force; and f) actuating the jarring portion to create a jarring impact.

* * * * *